United States Patent [19]

Hurt

[11] 3,971,466

[45] July 27, 1976

[54] BELT TRANSFER MEANS FOR CIGARETTES OR THE LIKE

[76] Inventor: James S. Hurt, Rte. No. 2, P.O. Box 208, Ashland, Va. 23005

[22] Filed: Apr. 10, 1974

[21] Appl. No.: 459,626

[52] U.S. Cl. ..... 198/20 C; 198/22 R; 198/208

[51] Int. Cl.[2] ..... B65G 47/00

[58] Field of Search ..... 198/20 C, 20 T, 22 R, 198/22 C, 25, 28, 208, 102, 103, 168, 160; 131/94

[56] References Cited

UNITED STATES PATENTS

| | | | |
|---|---|---|---|
| 2,109,617 | 3/1938 | Gwinn et al. | 198/20 C |
| 2,744,608 | 5/1956 | Ardell et al. | 198/103 X |
| 2,920,751 | 1/1960 | Krupp et al. | 198/208 |
| 3,717,236 | 2/1973 | New | 198/25 |

FOREIGN PATENTS OR APPLICATIONS

| | | | |
|---|---|---|---|
| 1,146,206 | 3/1969 | United Kingdom | 131/94 |
| 636,721 | 5/1950 | United Kingdom | 198/20 R |

*Primary Examiner*—Robert J. Spar
*Assistant Examiner*—James M. Slattery

[57] ABSTRACT

Disclosed is a transfer means for transferring tubular articles such as cigarettes from one moving conveyor unit to a second moving conveyor unit. The device includes a flexible belt member extending partially around the surfaces of each of the respective conveyor units. These conveying units move in opposite directions, and accordingly the direction of wind of the belt member on each of the respective units is in reverse manner to the other, in order to effect a transfer operation.

18 Claims, 2 Drawing Figures

BELT TRANSFER MEANS FOR CIGARETTES OR THE LIKE

BACKGROUND OF THE INVENTION

The invention relates to transfer means for transferring tubular articles from one rotating conveying unit to a second rotating conveying unit. In particular, it relates to a flexible belt transfer member effecting a transfer of cylindrical articles, such as cigarettes, from a first rotating drum unit to a second rotating drum unit.

In mechanized handling or manufacture of cigarettes, the need commonly arises for an efficient method of transferring cigarettes being transported on the surface of one conveying unit to the surface of a second conveying unit. A standard mode of transfer that has been developed in the art provides a transferee conveying unit with suction apparatus, so that cigarettes can be drawn onto the transporting surface of this transferee unit from a transferor conveyor. A typical example of such prior art apparatus is shown in U.S. Pat. No. 3,527,234 issued to A. Hinzmann. However, in certain types of handling operations, use of such suction transfer is not feasible. For example, in a standard cigarette air or vacuum-testing device, the utilization of vacuum as the testing criteria precludes the use of vacuum apparatus on the conveying unit.

Current transfer apparatus incorporates a finely machined and calibrated metal arm to perform the operation of intercepting and picking off cigarettes from a transferor conveyor to a transferee conveyor. Unfortunately, slight misalignment of this intercepting arm results in inefficiency. Additionally, wearing of these arms necessitates replacement of this component relatively frequently; and such regular replacements create cost factors.

Hence, a mechanical transfer means is needed which affords efficient transfer of tubular articles from one conveying unit to a second conveying unit. Whereupon, it is an object of this invention to provide a transfer means which efficiently effects the transfer of tubular articles such as cigarettes from one conveying unit to another conveying unit.

It is further an object of this invention to provide a transfer means comprising economical replacement components.

It is another object to provide a transfer means allowing a mechanical transfer of cylindrical objects from one conveying unit to a second conveying unit without the use of suction apparatus.

Yet another object of this invention is to provide an efficient and economical transfer means which is readily adaptable to existing cigarette handling apparatus.

SUMMARY OF THE INVENTION

In accordance with principles of this invention, the objects as set forth are attained by providing a flexible belt member extending partially around the circumference of a rotating conveying drum, and continuing to extend, in reverse wind, around a central axle portion of a second oppositely rotating conveying drum unit. One end of this flexible belt member is fastened to a guiding bracket, while its opposite end is fastened to a spring biasing member. The transfer operation is accomplished by the removal of the conveyed cigarettes from a transferor unit to a transferee drum. The belt serves to pick off cigarettes from the transferor unit as the cigarettes approach the surface of the transferee drum. The belt, held under tension by the spring biasing member, then serves to retain the cigarettes on the transporting surface of the transferee drum, as it transports the cigarettes towards an air or suction testing station.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed on illustrating principles of the invention.

In the drawings.

DESCRIPTION OF A PREFERRED EMBODIMENT

Figure 1:
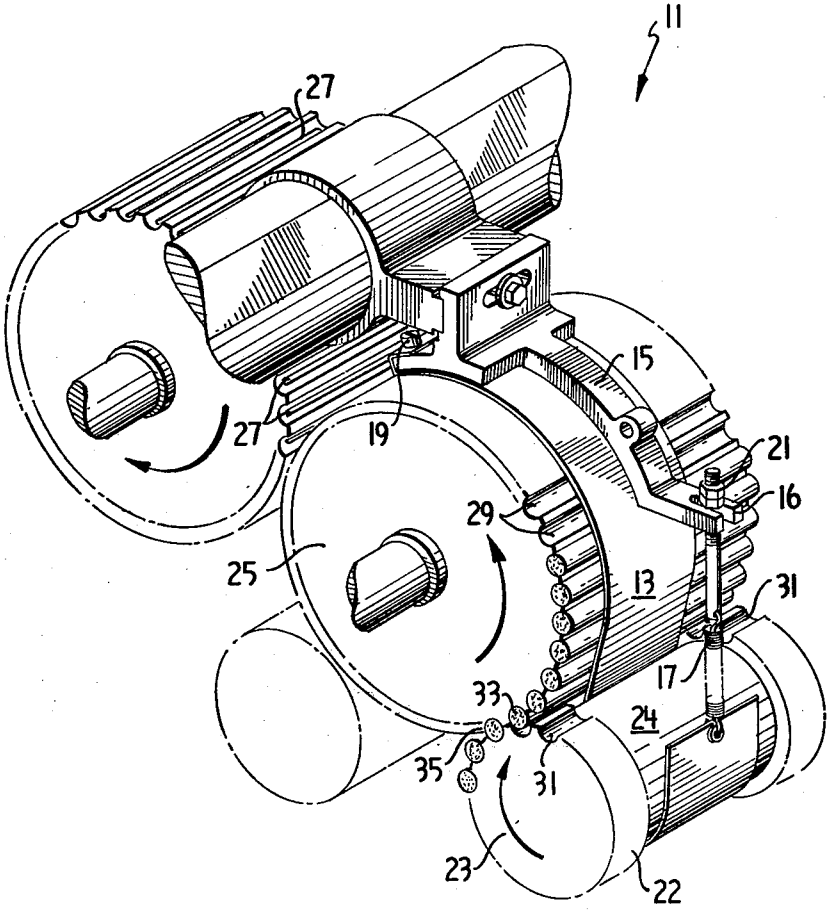
FIG. 1 is a perspective view showing a transfer means according to the invention, as a transfer component in a cigarette handling machine.
Figure 2:
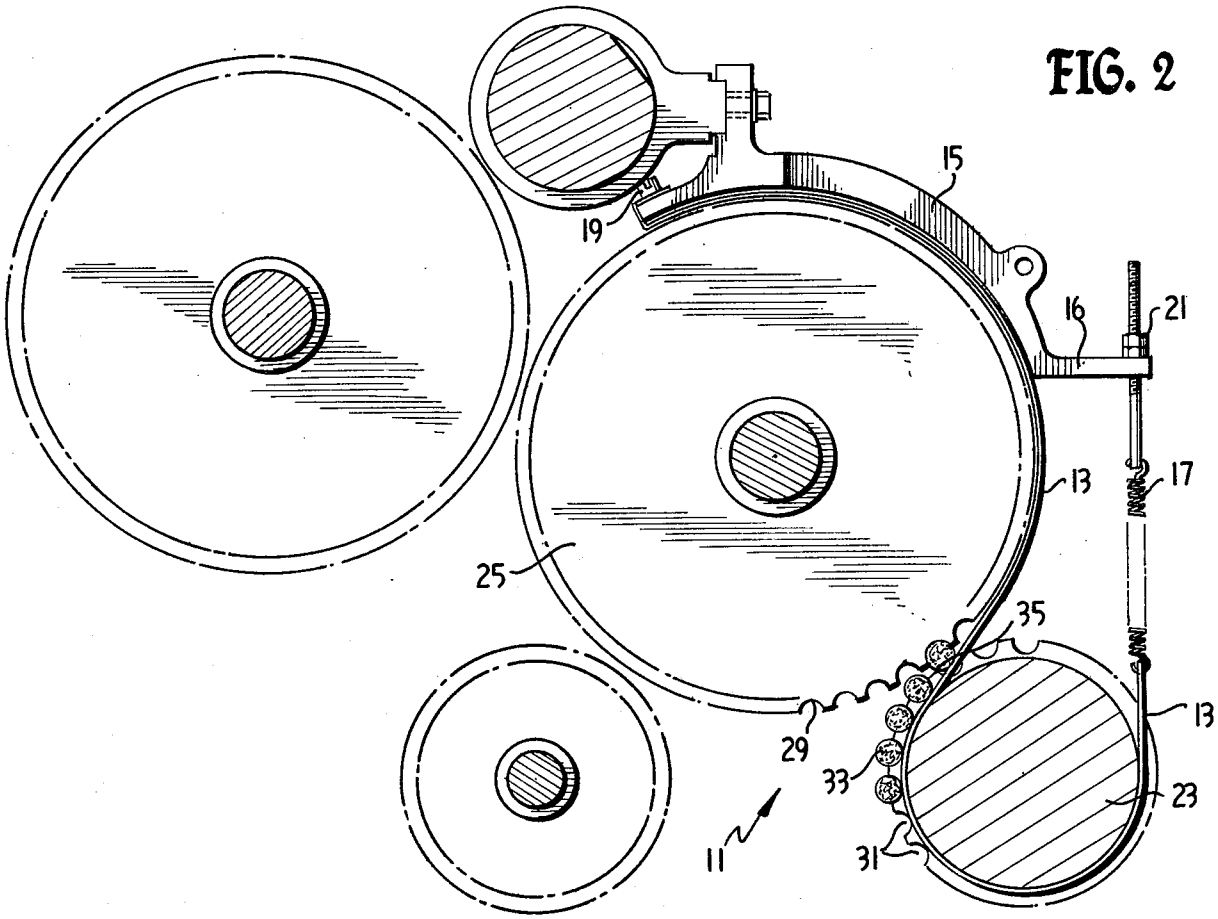
FIG. 2 is a side view of the apparatus shown in FIG. 1, illustrating the interaction of the belt and drum surfaces.

Referring to the elements of the invention as embodied in the drawings, numeral 11 generally represents a transfer means which comprises a flexible belt member 13 and a guide bracket 15. One end of the belt is fastened to the bracket by fastening screws 19, while the opposite end of the belt is connected by a spring biasing member 17 to a tension adjustment nut 21, also connected to a guide arm extension 16 of guide bracket 15.

Transfer means 11 is a transfer component of an overall device adapted to the handling of tubular articles, such as cigarettes. The particular device illustrated in FIG. 1 of the drawings depicts the use of my invention in conjunction with a cigarette air or suction testing apparatus. Basically, this machine includes a rotating selector drum 23 whose conveying surfaces are notched with article transport grooves 31. Articles carried on the selector drum are transferred to a rotating test drum 25, which also is fitted with article transport grooves 29. These two respective drums are rotating in opposite directions, as indicated by the directional arrows in the drawing. In order to eliminate cigarettes with torn or shreaded casings, rotating test drum 25 transports the cigarettes into passing contact with a rotating drum having suction slots 27. Unsuitable, damaged cigarettes on the air or suction drum are subsequently removed from the packing procedures, and only perfect cigarettes pass inspection and are carried off by the vacuum slots 27 for further packing.

My invention is directed to a transfer means for accomplishing the transferring of cigarettes being transported on rotating selector drum 23 to rotating test drum 25. Belt member 13 is made of flexible material, such as Mylar or some other suitable plastic material. The belt is fastened at one end to curved guide bracket 15 and extends around about 90° or so of the circumferential conveying surface of test drum 25. The belt also passes in reverse winding direction around about 90°–180° or so of central axle portion 24 of the adjoining transferor conveying unit 23. Its end is then attached through a spring biasing member 17 to tension adjustment nut 21, which in turn is connected, for example, to guide arm extension 16. Manipulation of adjustment nut 21 permits fine adjustment of the tension of the transfer belt member.

As shown in FIG. 1, selector drum 23 has a spool-like configuration. Cylindrical articles are supported by grooves 31 notched in the ridge portions 22 of the spool. The transfer belt accordingly extends out of contact with, and beneath transported cylindrical articles, until the articles reach the tangential transfer point 35. At the point of transfer, cigarettes 33 are guided by the belt member from the transferor drum unit 23 to the transferee drum unit 25. Drum 25 also is fitted with article transport grooves 29 which receive the transferred cigarettes. The belt member, biased by spring 17, is held in gentle selected tension against the surface of the drum 25. The cigarettes pass over the inner surface of the flexible belt, and accordingly are held in place by the tension of the belt against the drum. The cigarettes remain in their transport grooves of the test drum until they come into contact with suction slots 27 which selectively remove properly formed cigarettes.

While the invention has been particularly shown and described with reference to preferred embodiments thereof, it will be understood by those skilled in the art that various alterations in form and detail may be made therein without departing from the spirit and scope of the invention. For example, the transfer belt itself could be composed of various materials, such as leather or other plastics. The circumferential extent to which the belt is wrapped around the respective conveying drums also could be altered without substantially effecting performance. Furthermore, the particular design and arrangement of the guide bracket was chosen to accommodate adaptability of my invention to current cigarette handling machine structures, and could be altered to suit other particular purposes.

The embodiments of the invention in which an exclusive property or privilege is claimed are defined as follows:

1. A transfer means for transferring tubular articles from one moving conveyor unit to a second moving conveyor unit, comprising:

a non-driven belt member extending at least partially around a transporting surface of a transferee moving conveyor unit, also extending in reverse wind at least partially across the surface of a transferor moving conveyor unit for contacting tubular articles on the transferor moving conveyor and urging them toward the transferee moving conveyor;

a guide bracket which serves to maintain the belt member in operable position, so that articles are transferred by the belt member from a transporting surface of said transferor moving conveyor unit to said transporting surface of said transferee moving conveyor unit; and a biasing member for lengthwise tensioning said non-driven belt member and thereby urging said non-driven belt member toward said transporting surface of said transferee moving conveyor unit.

2. The transfer means of claim 1 wherein said belt member is flexible.

3. The transfer means of claim 1 wherein said biasing member is a spring attached to an end of the belt member.

4. The transfer means of claim 1 wherein said belt means is a non-continuous flexible belt.

5. The transfer means of claim 3 wherein a second end of said belt member is fixed to said guide bracket.

6. The transfer means of claim 1 wherein a transporting surface of at least one of the conveyor units includes article transporting grooves to support and restrain transported articles.

7. The transfer means of claim 1 wherein said transferor moving conveyor includes a grooved portion into which said belt member extends, such that said belt member extends beneath transported articles supported on the transferor moving conveyor, until such articles arrive at a tangential transfer point at which they are guided by said belt member to the transporting surface of the transferee moving conveyor, where the transported articles pass between the transporting surface of the transferee moving conveyor and the belt member and are held in place against the transporting surface by said belt member.

8. A transfer means for transferring tubular articles from one rotating drum unit to a second rotating drum unit, comprising:

a non-driven belt member extending at least partially across the circumferential surface of a transferee rotating drum, and also extending in reverse wind at least partially across the circumferential surface of a transferor rotating drum for contacting tubular articles on the transferor moving conveyor and urging them toward the transferee moving conveyor; and, a guide bracket means which serves to maintain the belt member in operable position, so that articles are transferred by the belt member from a transporting surface of said transferor rotating drum to a transporting surface of said transferee rotating drum, said guide bracket means including a biasing means for lengthwise tensioning said non-driven belt member and thereby urging said non-driven belt member toward said transporting surface of said transferee moving conveyor unit.

9. The transfer means of claim 8 wherein said belt member is flexible.

10. The transfer means of claim 8 wherein said biasing means is biased by a spring attached to one of its ends.

11. The transfer means of claim 8 wherein said belt means is a non-continuous flexible belt.

12. The transfer means of claim 11 wherein a second end of said belt member is fixed to said guide bracket means.

13. The transfer means of claim 8 wherein at least one of the rotating drum units includes article transporting grooves to support and restrain transported articles.

14. The transfer means of claim 8 wherein said transferor rotating drum comprises a spool-shaped member whose end does serve to support a transported article, and said belt member extends partially around the circumferential surface of the transferee rotating drum and also extends partially around the circumferential surface of an axle portion of the transferor rotating drum, such that the belt member extends beneath transported articles supported on the transferor rotating drum, until such articles meet a tangential transfer point at which they are guided by said belt member to the transporting surface of the transferee rotating drum, where the transported articles pass between the transporting surface of the transferee drum and the belt member and are held in place against the transporting surface by said belt member.

15. A method of transferring tubular articles from a first conveyor to a second conveyor by means of a non-driven belt member positioned and longitudinally tensioned to extend at least partially across a surface of said first conveyor and at least partially across the surface of said second conveyor, said method comprising the steps of:

moving said first conveyor in a first direction;

moving said second conveyor in the opposite direction;

bringing said tubular articles into engagement with said non-driven belt means on said first conveyor to thereby urge said tubular articles into engagement with said second conveyor so that said tubular articles move in said opposite direction between said belt means and said second conveyor.

16. The method of claim 15 including the step of extending said belt member beneath said tubular articles as said tubular articles are conveyed by said first conveying means.

17. The method of claim 15 including the steps of rotating said first and second conveyor means in opposite directions; and, extending said belt member across said first conveyor means in a first direction of wind and across said second conveyor means in the opposite direction of wind.

18. The method claim 17 including the step of extending said belt member beneath said tubular articles as said tubular articles are rotated on said first conveyor member; and, urging said tubular articles into engagement with said second conveyor member at a point on the circumference thereof proximate a point of tangency between said first and second conveyor means.

* * * * *